United States Patent [19]

Scott

[11] 4,299,307

[45] Nov. 10, 1981

[54] OIL LEVEL INDICATING AND REFILLING DEVICE

[76] Inventor: Nathaniel Scott, 501 E. Bolton, Savannah, Ga. 31401

[21] Appl. No.: 45,699

[22] Filed: Jun. 5, 1979

[51] Int. Cl.[3] ..... F01M 11/12; F01M 11/06

[52] U.S. Cl. ..... 184/103 R; 184/1.5; 184/6.4

[58] Field of Search ..... 184/103 R, 103 A, 105 R, 184/1.5, 6.4

[56] References Cited

U.S. PATENT DOCUMENTS

| | | | |
|---|---|---|---|
| 1,503,334 | 7/1924 | Norris | 184/103 R |
| 1,705,845 | 3/1929 | Woodman | 184/103 R |
| 1,924,704 | 8/1933 | Bartholomew | 184/103 R X |
| 2,564,231 | 8/1951 | Pitney | 184/103 R X |
| 2,615,442 | 10/1952 | Berry | 184/103 R X |
| 2,626,017 | 1/1953 | Bibko | 184/103 A |
| 2,836,259 | 5/1958 | Norton | 184/103 R |
| 3,447,636 | 6/1969 | Bonfilio | 184/1.5 |
| 3,876,037 | 4/1975 | Rath | 184/103 R X |
| 3,882,967 | 5/1975 | Gulla et al. | 184/103 R |

*Primary Examiner*—David H. Brown
*Attorney, Agent, or Firm*—Harvey B. Jacobson

[57] ABSTRACT

A tube is inserted to a predetermined depth into the dip stick orifice of an internal combustion engine of a vehicle and connected to a small pump to initiate oil circulation in a line between the dip stick orifice and the oil filler tube. A pressure sensitive switch is inserted in this line and held in a normally open position while sufficient pressure is being sensed. When the oil level of the engine falls below the tube, the oil pressure sensed by the oil sensor switch drops and the contacts close lighting an indicator light disposed on the instrument panel of the vehicle. An oil reservoir is positioned above the engine and is connected to the oil filler tube. A valve is disposed between the reservoir and the oil filler tube of the engine and can be operated through a remote control from inside the vehicle. When the oil warning light is actuated, the vehicle operator can actuate the valve to allow a predetermined amount of oil to flow into the engine.

8 Claims, 8 Drawing Figures

OIL LEVEL INDICATING AND REFILLING DEVICE

BACKGROUND OF THE INVENTION

1. Field of the Invention

This invention relates to a system for indicating the oil level in the oil pan of an internal combustion engine and adding a predetermined quantity of oil thereto when necessary.

2. Description of Related Art

It is well-known that if the oil level in the oil pan of an internal combustion engine drops below a prescribed level irreparable harm will be done to the internal components of the engine. Accordingly, modern automobiles are equipped with an oil pressure gauge to indicate a lack of adequate pressurized oil circulation within the engine. However, by the time the oil pressure gauge, generally nothing more than a light bulb, indicates that the oil pressure has dropped, there is little or nothing that can be done about it. The automobile must be stopped immediately and an additional source of oil must be sought. All too often the operator of the vehicle attempts to continue travelling with inadequate oil pressure thus injuring his vehicle. Inasmuch as modern automobiles are equipped with such pressure sensors, it is incumbent upon the vehicle operator to maintain a supply of oil or have his oil checked through the use of a dip stick at regular intervals. However, most modern drivers are not prone to take such measures and therefore some device which can aid in the avoidance of engine damage due to lack of oil is necessary.

Several systems for maintaining the proper level of oil within an engine have been proposed. U.S. Pat. No. 2,564,231, issued Aug. 14, 1951, to Pitney, shows a liquid level maintainer which includes an airtight auxiliary oil reservoir disposed above the engine and a tube extending from the reservoir to a predetermined height in the engine oil pan. When the oil in the oil pan falls below the tube, air enters the reservoir and oil from the auxiliary reservoir is allowed to enter the oil pan. U.S. Pat. No. 2,615,442, issued Oct. 28, 1952, to Berry, shows an oil maintaining apparatus wherein a float is disposed in the engine crankcase for indicating the level of oil therein. The feeding of oil from a reservoir to the crankcase is produced by vacuum of suction from the intake manifold. U.S. Pat. No. 3,282,380, issued Nov. 1, 1966, to Burrell et al shows an automobile oil changer wherein a reversible pump is connected in a line which extends from the drain opening of an engine crankcase to a container located above the engine. The pump is operated in a first direction for removing oil from the engine and depositing it in the container. The container can be filled with fresh oil and the pump operated in a second direction for refilling the engine. U.S. Pat. No. 3,447,636, issued June 3, 1969, to Bonfilio, shows an automatic oil exchanging system having a first container for receiving the used oil from the engine crankcase and a second container for storing a fresh oil supply to be dispensed to the crankcase. The system automatically removes engine oil to the first container and, when this is accomplished, replaces it with a fresh oil from the second container. U.S. Pat. No. 4,091,895, issued May 30, 1978, to Lang, shows an oil level sensing and replenishing apparatus comprising a standpipe type sensing apparatus which allows venting of an auxiliary oil reservoir to provide gravity induced fluid flow from the reservoir to the crankcase when the level of the crankcase is below a predetermined minimum.

SUMMARY OF THE INVENTION

The present invention includes an auxiliary oil reservoir mounted above the engine and connected thereto through a valved line. The valve is operated through a manual actuation device mounted within the passenger compartment of the vehicle. A level sensing device is mounted within the auxiliary reservoir and connected to a plurality of lights mounted within the passenger compartment for indicating the oil level within the auxiliary reservoir. A sensor is connected to the engine oil pan and signals the vehicle operator when the oil level therein falls below a predetermined minimum. In one form, the sensor includes a small pump connected in a line with a tube which extends down the dip stick receiving aperture of the engine and ends at a predetermined height within the oil pan. The pump maintains an oil flow through this tube and through a further line connected to one of the engine valve covers for returning the oil to the oil pan. A pressure sensor is connected in this oil flow path. The pressure sensor illuminates a signalling light when it senses a low pressure thus indicating that the level of oil in the oil pan has fallen below the bottom of the tube disposed in the dip stick receiving aperature. A second sensor embodiment is comprised of a housing having a float actuated switch therein. The housing is connected to the oil pan through a tube which must be attached through the bottom or side of the oil pan.

Accordingly, one object of the present invention is to provide an oil level indicating and refilling device which is relatively easy to attach to the engine of a presently existing automobile.

Another object of the present invention is to provide an oil level indicating and refilling device which can be operated from the passenger compartment of a vehicle utilizing the device.

A further object of the present invention is to provide an oil level indicating and refilling device which is simple, efficient to maintain, yet provides an accurate means of monitoring the oil level in the engine oil pan and replenishing same when necessary.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
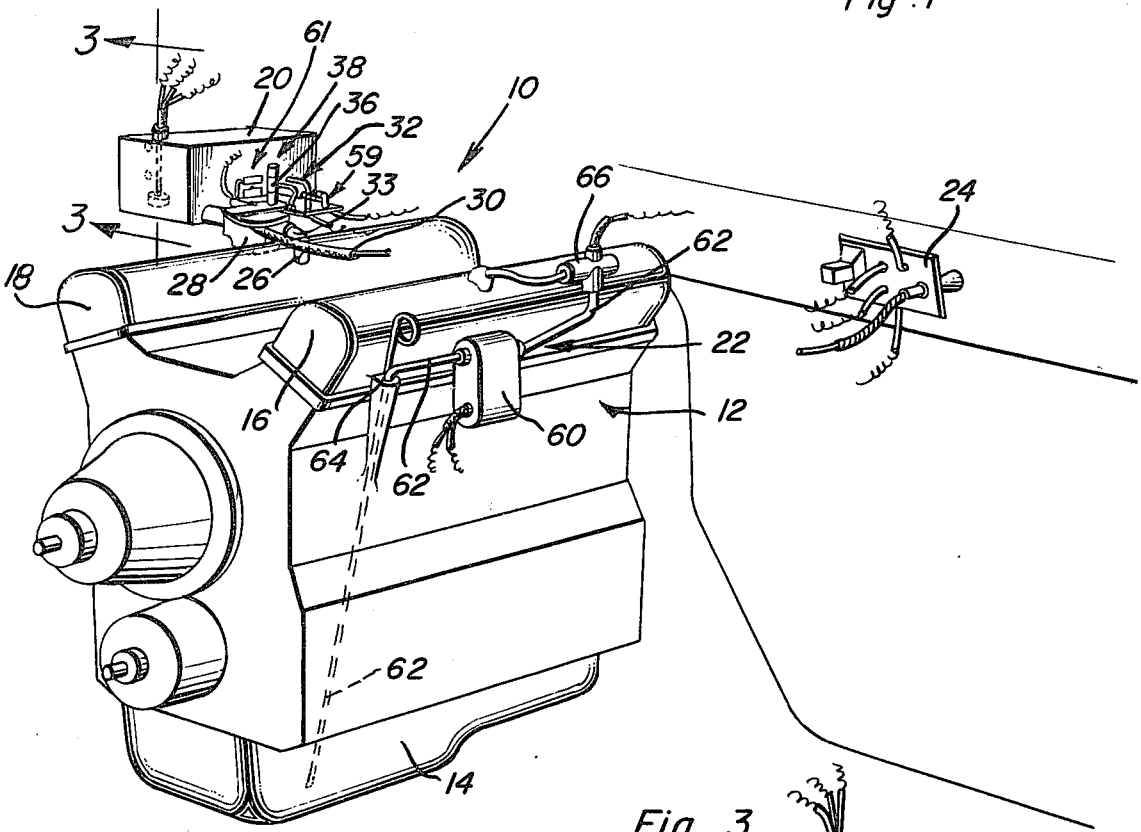
FIG. 1 is a perspective view of an internal combustion engine incorporating the device of the present invention.

Now with reference to the drawings, the oil level indicating and refilling device of the present invention, generally referred to by the numeral 10, will be set forth in detail. With particular reference to FIG. 1, it can be seen that the oil level indicating and refilling device is connected to a standard internal combustion engine 12 having oil pan 14 and valve covers 16 and 18. The device 10 includes auxiliary oil reservoir 20 and a sensor 22. Reservoir 20 and sensor 22 are appropriately connected to control an indicator panel 24 which is mounted in the dash of the vehicle in a manner so as to be facing the vehicle operator.

Figure 2:
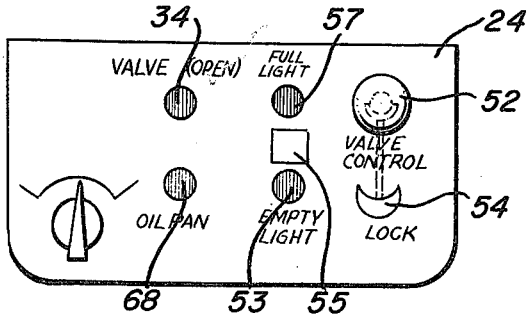
FIG. 2 is a front elevational view of the control and indicator light panel of the present invention.
Figure 5:
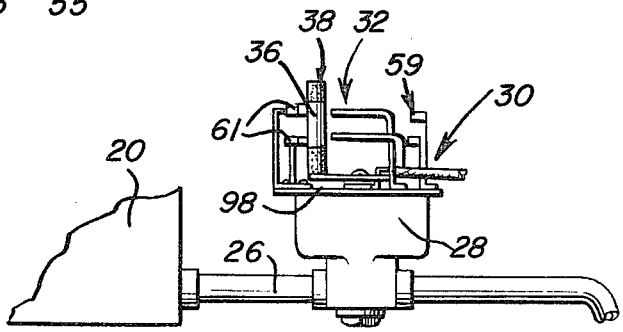
FIG. 5 is a side elevational view of the control valve of the present invention.
Figure 4:
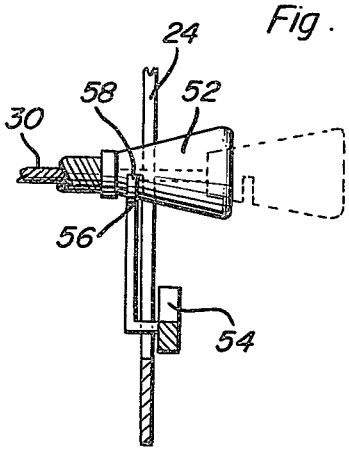
FIG. 4 is a side elevational view of the control valve operating handle.

It will be noted that the reservoir 20 is mounted above the top of engine 12 and is connected through tube 26 to the valve cover 18. Tube 26 includes valve 28 which is operated through a pull cable 30. With reference to FIGS. 2, 4 and 5, it will be seen that also connected to valve 28 is a set of contacts 32 which illuminate a valve warning light 34 through leads 33 when the valve is in the open position. Contacts 32 are vertically spaced from each other and are adapted to be bridged by conductive member 36 which is mounted on actuation arm 38 of valve 28. Each contact 32 comprises a curved conductive wire which is positioned so as to remain in contact with conductive member 36 for the entire extent of travel of arm 38 when the valve is open. Further, it will be seen that an actuation knob 52 is mounted on panel 24. Knob 52 is pulled away from the panel to actuate valve 28 through cable 30 and arm 38. It will be noted that a lock member 54 is also mounted on the panel 24. Lock member 54 can be biased upwardly and has a tip portion 56 which sits within cooperating slot 58 of the knob to lock the valve 28 in the closed position and avoid any inadvertent actuation of the valve.

Figure 3:
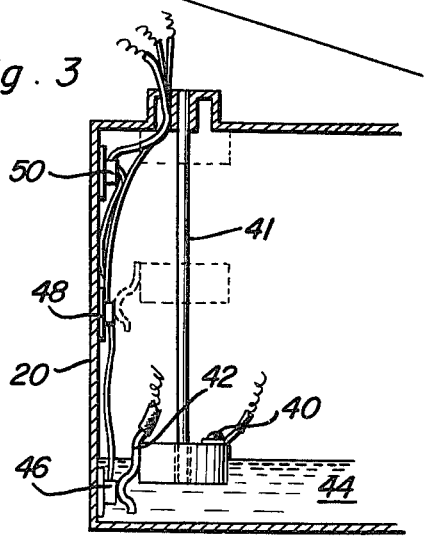
FIG. 3 is a fragmental sectional view of the auxiliary reservoir showing the float mechanism therein.
Figure 8:
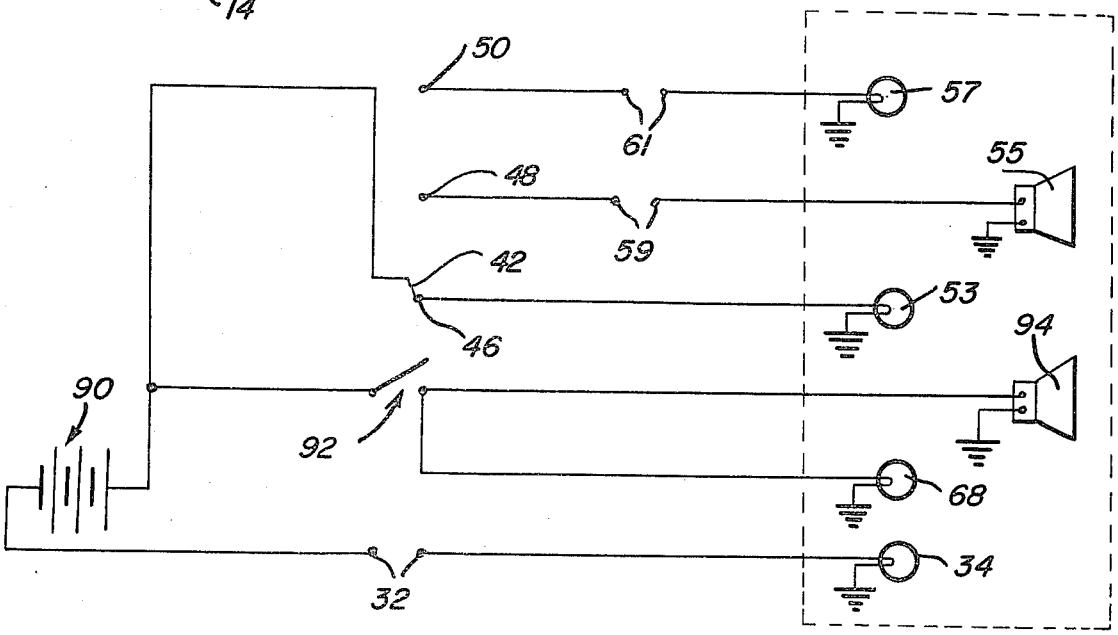
FIG. 8 is a schematic diagram of the wiring circuit of the present invention.

Contained within the reservoir 20 is a float 40 shown in FIG. 2 which carries a movable contact 42. The reservoir 20 can contain up to two quarts of reserve oil 44 therein. Stationary contacts 46, 48 and 50 are attached to one wall of reservoir 20 for indicating the level therein. Contact 50, of course, provides a signal when two quarts of oil are in the reservoir while contact 48 indicates the presence of one quart of oil and contact 46 indicates that the reservoir is empty of oil. Contacts 46, 48 and 50 cause the energization of, respectively, light 53, buzzer 55 and light 57 which are located on panel 24. Float 40 rides on vertical shaft 41 with the float position on the shaft being determined by the oil height. As seen in FIGS. 3, 5 and 8, buzzer 55 and light 57 are energized only when contacts 59 or 61 are bridged, respectively. Contacts 59 are bridged by conductive strip 36 when the valve is fully open. Accordingly, when valve 28 is opened to allow reserve oil to enter the engine oil pan, buzzer 55 will sound when one quart of oil has entered the oil pan to alert the operator to close the valve. Light 57 is energized through contact 50 in cooperation with contacts 61 when valve 28 is fully closed, allowing conductive member 36 to bridge contacts 61.

The sensor 22 shown in FIG. 1 comprises a pump 60 which is connected in line 62. Line 62 extends at one end into the aperture 64 in which the dip stick is normally placed. The line extends downwardly into the oil pan 14 and terminates slightly below the desired level of oil within pan 14. The opposite side of line 62 extends through pressure gauge 66 and into valve cover 16. Accordingly, when pump 60 is operating, oil is drawn up through the end of tube 62 which is disposed in the oil pan and forced through pressure gauge 66 and into valve cover 16 where it can drain back down into the oil pan. If an adequate oil supply is maintained in the oil pan 14, sufficient oil will be pumped through the sensor system to keep the pressure switch 66 activated. When the oil level drops below the end of tube 62, the pressure sensor completes a circuit to oil pan light 68 on panel 24 shown in FIG. 2. The pressure switch 66 can also operate a buzzer, if desired. Obviously, once light 68 has lit to indicate a lack of oil in pan 14, all the vehicle operator has to do is release knob 52 and pull it away from the control panel 24 thereby opening valve 28 and allowing oil to flow in the engine from the auxiliary reservoir 20. As soon as a full quart of oil has been deposited in the oil pan, the buzzer 55 will be energized to indicate that valve 28 should be closed.

Figure 6:
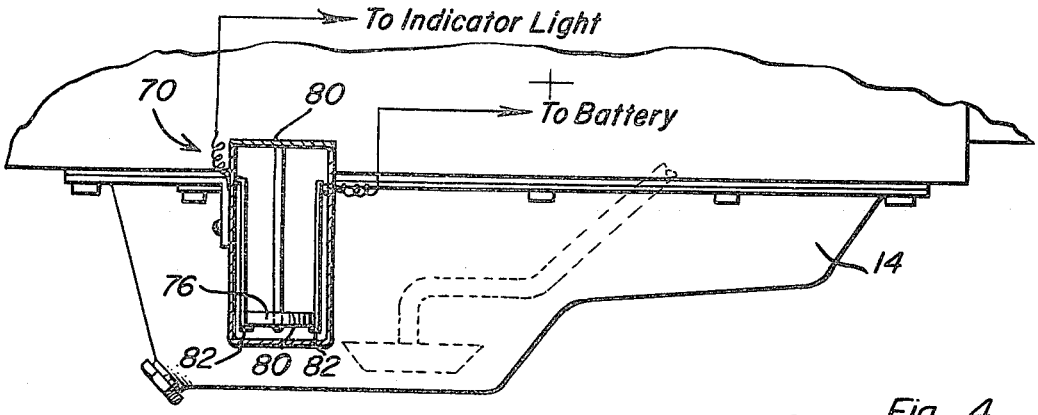
FIG. 6 is a side elevational view showing a second sensor which can be used with the present invention.
Figure 7:
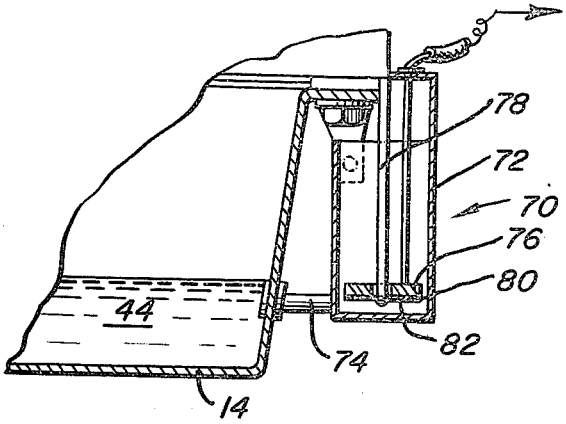
FIG. 7 is an end elevational view showing the sensor of FIG. 6.

A second embodiment of an oil pan sensor is shown in FIGS. 6 and 7 and labeled 70. Sensor 70 includes a housing 72 which is mounted alongside of oil pan 14 in any convenient manner and includes a hollow tube 74 which communicates the interior of the housing 72 with the interior of oil pan 14. The sensor includes a float member 76 which is mounted within the housing and rides on vertical rod member 78. Float member 76 has a conductive surface contained on the bottom thereof. Surface 80 bridges stationary contacts 82 to complete the circuit to a warning light when the level of oil 44 in oil pan 14 falls below a prescribed minimum. The light to be illuminated by the engagement of surface 80 with contacts 82 is, of course, light 68 on panel 24 as shown in FIG. 2. Naturally, any necessary venting of housing 72 will be accomplished through the top thereof.

FIG. 8 clearly sets forth the wiring diagram of the present invention. It will be seen with reference to that figure that the car battery 90 has its positive terminal connected to movable contact 42 which is disposed within auxiliary oil reservoir 20. That contact rides between contacts 46, 48 and 50 which are each respectively connected to warning light 53, buzzer 55 and warning light 57 with buzzer 55 and warning light 57 also connected through contacts 59 and 61, respectively. Furthermore, contacts 32 which are connected to the valve 28 operate warning light 34. Finally, contacts 92 are connected to warning light 68, which is the oil pan warning light, and also to a horn 94 which gives an audible indication of low oil level in the oil pan 14. Contacts 92 would be, in the first embodiment, the contacts of pressure switch 66 or, in the second sensor embodiment, the surface 80 and contacts 82. In either embodiment, the result achieved is the same.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An oil level indicating and refilling device for use on an internal combustion engine, comprising;

an auxiliary reservoir for storing oil to replenish the oil supply of said internal combustion engine, said reservoir being mounted over said engine;

a connector line containing a normally closed valve, said connector line being connected between said auxiliary reservoir and said internal combustion engine;

a sensor connected to the oil pan of said internal combustion engine and including a switch which is actuated upon the oil level in said oil pan falling below a predetermined minimum;

a first indicator light connected to said sensor, said indicator light being energized upon closure of said switch; and manual actuation means connected to said valve for opening said valve.

2. The device of claim 1 wherein said switch is a pressure sensitive switch and said sensor includes a tube disposed in the oil pan of said engine and extending outside of said engine, said tube being connected to a pump and further being connected to said pressure sensitive switch, the opposite end of said tube being disposed in a valve cover of said engine; said indicator light being connected to said pressure sensitive switch for being illuminated when the oil in said oil pan falls below the level of the end of said tube.

3. The device of claim 2 wherein said tube extends into said oil pan through the dip stick opening of said engine.

4. The device of claim 3 wherein said pressure sensitive switch also activates an audible alarm when the level of oil in said oil pan falls below the bottom of said tube.

5. The device of claim 1 and further wherein said auxiliary oil reservoir includes an oil level indicating apparatus for providing an indication of the oil remaining therein.

6. The device of claim 5 wherein said oil level indicating apparatus includes a float mounted in said reservoir and carrying a movable contact, a plurality of stationary contacts mounted in said reservoir in vertically spaced arrangement, said plurality of stationary contacts being individually contacted by said float mounted contact.

7. The device of claim 6 wherein one of said stationary contacts is positioned to indicate that said reservoir is full; a first set of contacts mounted on said valve and connected to said valve such that they are operative when said valve is closed, said first set of contacts being in circuit with said one of stationary contacts and further in circuit with a first indicator means for exciting said indicator means when said auxiliary reservoir is full and said valve is closed.

8. The device of claim 7 wherein a second one of said stationary contacts is positioned to indicate that said reservoir is less than full; a second set of contacts mounted on said valve, said second set of contacts being actuated when said valve is opened, said second set of contacts being in circuit with said second one of said stationary contacts and further in circuit with a second indicator means for indicating when said valve is open and said reservoir is less than full.

* * * * *